US007543610B2

(12) United States Patent
Kläui et al.

(10) Patent No.: US 7,543,610 B2
(45) Date of Patent: Jun. 9, 2009

(54) THREAD CLAMP FOR A RAPIER HEAD

(75) Inventors: Erich Kläui, Seuzach (CH); Marius Bachofen, Benken (CH); Dietmar Markward, Rüti (CH)

(73) Assignee: Sultex AG, Ruti (CH)

( * ) Notice: Subject to any disclaimer, the term of this patent is extended or adjusted under 35 U.S.C. 154(b) by 0 days.

(21) Appl. No.: 11/811,699

(22) Filed: Jun. 11, 2007

(65) Prior Publication Data

US 2007/0289656 A1 Dec. 20, 2007

(30) Foreign Application Priority Data

Jun. 16, 2006 (EP) ..... 06115598

(51) Int. Cl.

*D03D 47/23* (2006.01)
*D03D 47/27* (2006.01)
*D03D 47/28* (2006.01)
*D03D 23/00* (2006.01)

(52) U.S. Cl. ..... 139/452; 139/443; 139/444; 139/448; 139/103; 139/194

(58) Field of Classification Search ..... 242/365, 242/365.3, 365.6, 366.2, 615, 615.2, 157.1; 139/452, 443, 444, 446, 448, 447, 100, 103, 139/194, 450, 216

See application file for complete search history.

(56) References Cited

U.S. PATENT DOCUMENTS 4,126,159 A * 11/1978 Vercaemert ..... 139/449
4,178,590 A * 12/1979 Weidmann ..... 340/677
4,300,465 A * 11/1981 Tsuboi ..... 112/255
4,344,466 A * 8/1982 Hasegawa et al. ..... 139/449
4,431,036 A * 2/1984 Schnyder ..... 139/429
4,520,851 A * 6/1985 Rohr et al. ..... 139/448
4,674,544 A * 6/1987 Hintsch ..... 139/185
4,875,506 A * 10/1989 Gacsay et al. ..... 139/450
4,962,796 A * 10/1990 Grimm et al. ..... 139/450
5,020,573 A * 6/1991 Debaes ..... 139/453
5,179,980 A * 1/1993 Hubner et al. ..... 139/450
5,305,966 A * 4/1994 Motta ..... 242/149
5,323,324 A * 6/1994 Fredriksson ..... 700/130
5,398,731 A * 3/1995 Schuster ..... 139/194

(Continued)

FOREIGN PATENT DOCUMENTS

WO WO 99/60193 A1 11/1999

(Continued)

*Primary Examiner*—Bobby H Muromoto, Jr.
(74) *Attorney, Agent, or Firm*—Townsend and Towsend and Crew LLP

(57) ABSTRACT

A thread clamp for a rapier head (1) is presented which contains a clamping part (4) for firmly clamping a weft thread (3) and an actuator (5) for moving the clamping part (4). The actuator (5) includes a ferromagnetic core (12), an armature (11) and at least one winding (13) which is arranged on the core or armature in order to produce a magnetic field in the latter and to move the armature and the clamping part, which is operatively connected to the latter, with the core (12) having two limbs (12.1, 12.2) between which the armature (11) is movably arranged, and with each limb being provided with a permanent magnet (14.1, 14.2) in order to hold the armature at one of the two rest positions in the current-free state of the winding.

14 Claims, 3 Drawing Sheets

U.S. PATENT DOCUMENTS

| | | | | |
|---|---|---|---|---|
| 5,417,251 | A * | 5/1995 | Josefsson et al. | 139/450 |
| 5,476,122 | A * | 12/1995 | Schuster et al. | 139/194 |
| 5,492,153 | A * | 2/1996 | Stacher et al. | 139/453 |
| 5,492,286 | A * | 2/1996 | Motta | 242/419.5 |
| 5,544,680 | A * | 8/1996 | De Ro | 139/450 |
| 5,816,296 | A * | 10/1998 | Schuster | 139/450 |
| 6,161,595 | A * | 12/2000 | Shaw et al. | 139/194 |
| 6,189,576 | B1 * | 2/2001 | Markward | 139/54 |
| 6,305,434 | B1 * | 10/2001 | Speich | 139/448 |
| 6,418,976 | B2 * | 7/2002 | Loehr et al. | 139/450 |
| 6,505,653 | B1 * | 1/2003 | Tholander | 139/450 |
| 6,845,792 | B2 * | 1/2005 | Scari et al. | 139/448 |
| 7,040,353 | B2 * | 5/2006 | Covelli | 139/194 |
| 7,077,168 | B2 * | 7/2006 | Herrlein et al. | 139/194 |
| 7,128,098 | B2 * | 10/2006 | Verclyte | 139/448 |
| 7,156,337 | B2 * | 1/2007 | Halvarsson et al. | 242/364.8 |
| 7,249,725 | B2 * | 7/2007 | Klaeui et al. | 242/157.1 |
| 2003/0037591 | A1 * | 2/2003 | Ashton et al. | 73/12.08 |
| 2003/0094210 | A1 * | 5/2003 | Markward et al. | 139/293 |
| 2003/0183297 | A1 * | 10/2003 | Scari et al. | 139/448 |
| 2003/0188794 | A1 * | 10/2003 | Berktold et al. | 139/11 |
| 2004/0061018 | A1 * | 4/2004 | Halvarsson et al. | 242/361 |
| 2004/0099329 | A1 * | 5/2004 | Klaui et al. | 139/448 |
| 2005/0034775 | A1 * | 2/2005 | Schaich et al. | 139/435.1 |
| 2005/0145290 | A1 * | 7/2005 | Jacobsson et al. | 139/450 |
| 2005/0217094 | A1 * | 10/2005 | Josefsson | 28/240 |
| 2005/0284533 | A1 * | 12/2005 | Verclyte | 139/448 |
| 2006/0108018 | A1 * | 5/2006 | Siegl | 139/447 |
| 2007/0028989 | A1 * | 2/2007 | Gotti et al. | 139/383 A |
| 2007/0095418 | A1 * | 5/2007 | Halvarsson et al. | 139/452 |
| 2007/0157989 | A1 * | 7/2007 | Christe | 139/438 |
| 2007/0169830 | A1 * | 7/2007 | Christe | 139/448 |
| 2008/0018176 | A1 * | 1/2008 | Markward et al. | 307/104 |

FOREIGN PATENT DOCUMENTS

| | | |
|---|---|---|
| WO | WO 2004/035891 A2 | 4/2004 |

* cited by examiner

THREAD CLAMP FOR A RAPIER HEAD

CROSS-REFERENCE TO RELATED APPLICATIONS

This application claims the priority of European Patent Application No. 06115598.2, dated Jun. 16, 2006, the disclosure of which is incorporated herein by reference.

BACKGROUND OF THE INVENTION

The invention relates to a thread clamp for a rapier head and to a rapier head having a thread clamp of this kind as well as to a rapier weaving machine with a thread clamp of this kind or with a rapier of this kind.

In rapier weaving machines the weft thread is inserted into a shed by means of an inserting rapier, which is mounted on a bar or on a flexible band and is taken over at a transfer point in the central part of the shed by a receiving rapier and further forwarded. The inserting rapier has the task of reliably gripping the presented weft thread, of inserting the latter into the shed and of guiding it precisely to the receiving rapier. Each rapier includes a rapier head with a thread clamp in order to be able to firmly clamp the weft thread during the weft insertion. In the case of automatically clamping thread clamps the thread transfer takes place through drawing the weft thread respectively in or out of previously set clamping regions of the respective thread clamps. For the manufacture of cloths with weft yarns of different thicknesses or with weft yarns of different smoothness, controlled thread clamps can be used in one or both rapier heads, with the thread clamp of the inserting rapier being actively opened or that of the receiving rapier being actively closed during the thread transfer.

The controlled thread clamps can be controlled mechanically and/or electrically. An electrically controlled thread clamp with an electrical actuator is for example described in the publication WO 99/60193. The power supply for the controlled thread clamp takes place via an induction coil which is arranged in the rapier head and which is coupled inductively to a second induction coil which is mounted above the shed. The thread clamp which is described in WO 99/60193 includes a movable clamping part which is held closed by means of a prestressed spring. An electromagnet in the actuator serves for the opening of the clamping part. The disadvantage of this arrangement is that the electromagnet must be supplied with power in order to keep the thread clamp open, which can lead to an undesirable heating up of the electromagnet and of the other current carrying parts. The electrical energy consumption of this thread clamp is therefore comparatively high, even if the opening times of the thread clamp are short in relation to the entire weft insertion cycle.

SUMMARY OF THE INVENTION

An object of the present invention is to make available a thread clamp for a rapier head of a rapier weaving machine and a rapier head with a thread clamp of this kind as well as a rapier weaving machine with a thread clamp of this kind or with a rapier head of this kind, which require less electrical energy in comparison with the above-described prior art in order to keep the thread clamp open or closed.

This object is satisfied in accordance with the invention by the thread clamp and by the rapier head as well as by the rapier weaving machine described herein.

The thread clamp in accordance with the invention for a rapier head contains a clamping part for firmly clamping a weft thread and an actuator for moving the clamping part. The actuator includes a ferromagnetic core, an armature and at least one winding which is arranged on the core or armature in order to produce a magnetic field in the latter and to move the armature and the clamping part, which is operatively connected to the latter. The armature of the thread clamp in accordance with the invention is movably arranged between two rest positions, with at least one holding means being provided in order to hold the armature both in the one and in the other rest position in the current-free state of the winding. The core and the armature advantageously form a magnetic circuit. The core can for this purpose be formed in U-shape so that it has two limbs. Other core shapes are however also possible. For example the core can be I-shaped and the armature U-shaped, or both the core and armature can be U-shaped or L-shaped. In an advantageous embodiment the armature is formed as a rocker armature.

In a further advantageous embodiment at least one permanent magnet, e.g. a bar magnet, is provided as holding means, which can for example be arranged at the core or at the armature. In a preferred variant embodiment the core has two limbs, between which the armature is movably arranged, with two permanent magnets being provided in order to hold the armature firmly in each case at one of the two limbs in the current-free state of the winding. Each limb is advantageously provided with a permanent magnet, with it being possible in each case for the permanent magnets to be arranged on the inner side of the limbs and/or in an end region thereof. It is, however, also possible to arrange the permanent magnets on the armature or a separate mounting part. Furthermore, a spring element, for example, can also be provided as a holding means. For example, the spring element can be stressed when the armature departs from one of the two rest positions, so that the spring force holds the armature firmly in the respective rest position.

In an advantageous variant the core and/or the armature are constructed of transformer metal sheet. In a further advantageous variant the clamping part is formed on the armature.

In a further advantageous variant the winding is connected to an energy store, for example to an accumulator or condenser. The winding is advantageously connected to the energy store via a control circuit.

In a further advantageous variant embodiment the thread clamp can in addition be actuated mechanically and/or pneumatically. The thread clamp can thereby for example be opened and closed mechanically and/or pneumatically outside the shed, which reduces the electrical energy consumption and the heating associated therewith.

Furthermore, the invention includes a rapier head with a thread clamp in accordance with any one of the above-described embodiments, with it being possible for the rapier head to be formed as an inserting rapier or a receiving rapier, as well as a rapier weaving machine with a thread clamp in accordance with any one of the above-described embodiments and/or with a rapier head in accordance with the above description.

The thread clamp in accordance with the invention and the rapier head in accordance with the invention as well as the rapier weaving machine in accordance with the invention have the advantage that the actuator of the thread clamp requires no power either in the closed position or also in the open position of the thread clamp, since the armature is in each case in a rest position which corresponds to the closed or open state of the thread clamp respectively, in which it is held firmly by the holding means. Current is required only for opening and closing of the thread clamp. The total power consumption of the thread clamp is thereby reduced and the actuator can be made smaller and lighter in comparison with actuators of conventional thread clamps without leading to an undesirable warming up of the electromagnet and the other current carrying parts. In addition it is possible in certain phases of the weaving cycle, e.g. when the rapier head is located outside the shed, to actuate the actuator mechanically or pneumatically, which further reduces the heating up of the actuator.

The above description of embodiments serves merely as an example. Further advantageous embodiments are given in the subordinate claims and the drawings. Moreover, in the context of the present invention, individual features from the described or illustrated embodiments and variants can also be combined with one another in order to form new embodiments.

The invention will be explained in the following in more detail with reference to the exemplary embodiment and with reference to the drawings.

DESCRIPTION OF THE PREFERRED EMBODIMENTS

Figure 1:
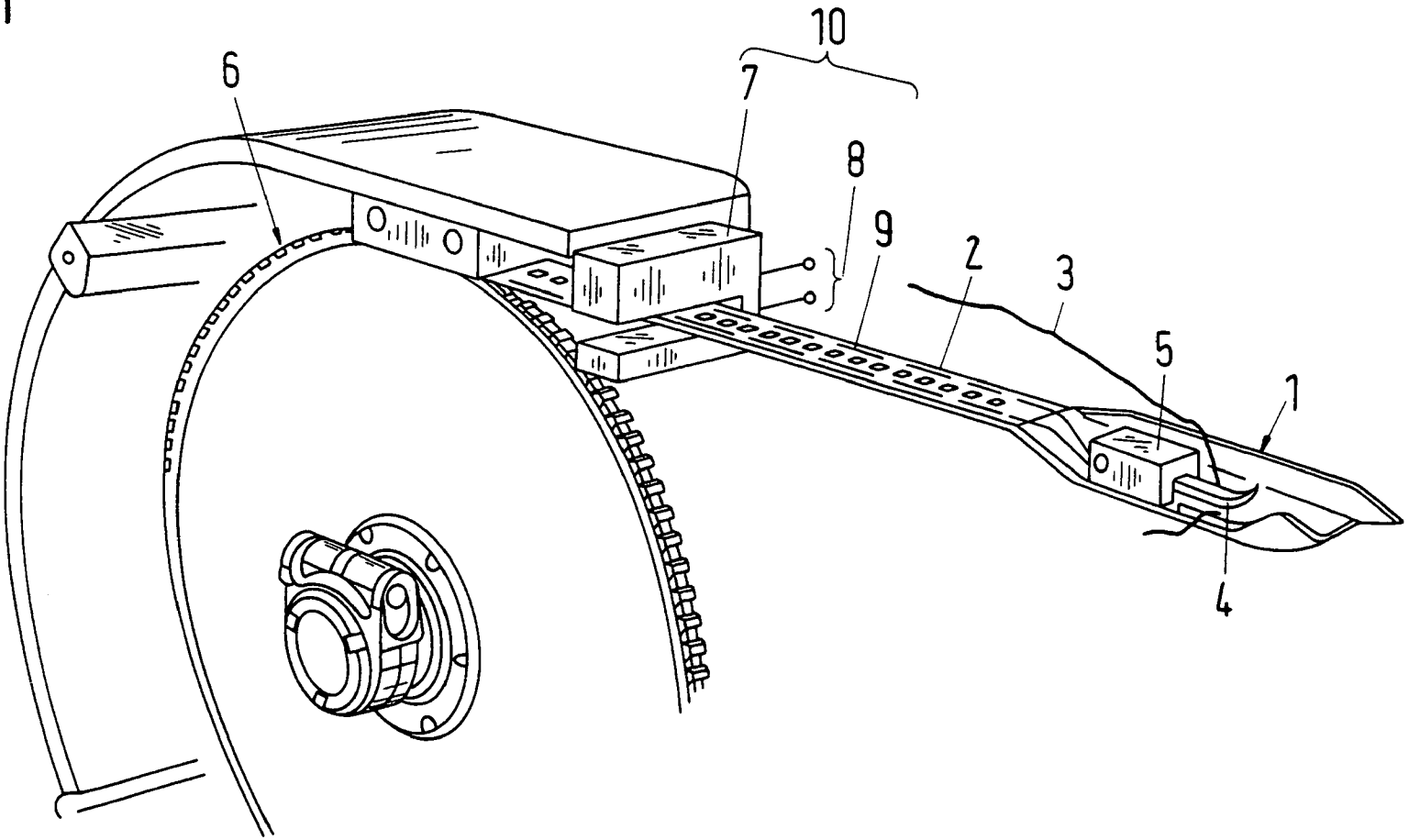
FIG. 1 is a schematic illustration of a rapier head and of a band drive with an exemplary embodiment of a thread clamp in accordance with the present invention, in a perspective view.

FIG. 1 shows a schematic illustration of a rapier head 1 and of a band drive with an exemplary embodiment of a thread clamp in accordance with the present invention in a perspective view. The rapier head 1 is connected to a band 2 which is displaceable in the longitudinal direction and which can be moved forwards and backwards by a band drive 6. The band drive 6 includes for example, as shown in FIG. 1, a drive wheel which is provided with teeth at its periphery which engage in cut-outs of the band 2. The band guides for guiding the band 2 in the longitudinal direction have been omitted from FIG. 1 for the sake of clarity. If the band is made flexible, it can be led around the drive wheel, as shown in FIG. 1.

The thread clamp which, as is shown in FIG. 1, can be arranged in the rapier head 1 contains in the exemplary embodiment a clamping part 4 for firmly clamping a weft thread 3 and an actuator 5 for moving the clamping part 4. For controlling the actuator 5 the latter can be connected directly to the secondary induction coil 9 or via a converter/control circuit, which can for example contain a demodulator and/or an amplifier. Through corresponding control of the actuator the clamping part 4 can be pressed against a support or the pressed on clamping part can be opened.

Figure 3:
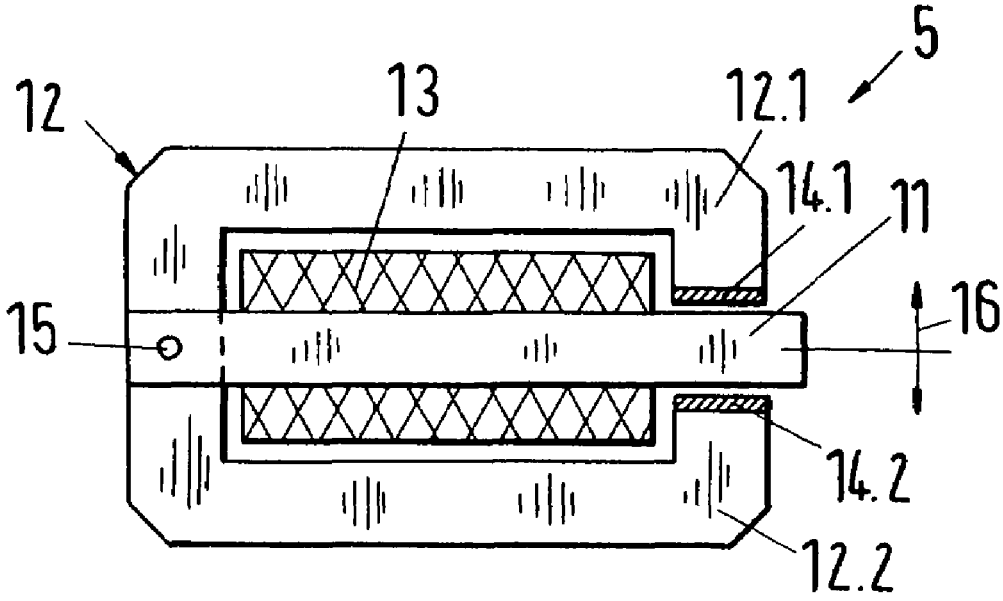
FIG. 3 is an exemplary embodiment of an actuator of a thread clamp in accordance with the present invention.

For the description of the present exemplary embodiment reference is also made in the following to FIG. 3. In the exemplary embodiment the actuator 5 includes a ferromagnetic core 12, an armature 11 and at least one winding 13, which is arranged on the core or armature in order to generate a magnetic field in the latter and to move the armature and the clamping part, which is operatively connected to it. The armature 11 is movably arranged between two rest positions, with at least one holding means 14.1, 14.2 being provided in order to hold the armature either in the one or else in the other rest position in the current-free state of the winding. In the exemplary embodiment which is shown in FIG. 3 the core 12 has two limbs 12.1, 12.2 between which the armature 11 is movably arranged, with two permanent magnets 14.1, 14.2 being provided as holding means in order to respectively hold the armature firmly in a rest position at one of the two limbs 12.1, 12.2 in the current-free state of the winding. As is shown in FIG. 3, the core 12 can for example be formed in U-shape. In an advantageous variant the core 12 and/or the armature 11 are constructed of transformer metal sheet. In a further advantageous variant the clamping part 4 is formed on the armature 11 or the armature itself acts as a clamping part.

In an advantageous embodiment the permanent magnets 14.1, 14.2 are in each case arranged on the inner side of the limbs 12.1, 12.2 and in an end region of the latter. In a further advantageous embodiment the armature 11 is formed as a toggle or rocker armature which can be rocked about an axis 15. In this embodiment the part of the armature which is remote from the axis 15 can be moved between the two limbs 12.1, 12.2 in a direction 16 which extends substantially transverse to the longitudinal axis of the armature. In the current-free state of the winding the part of the armature which is remote from the axis 15 is drawn in by the field which is generated by the permanent magnets to the closest lying limb 12.1, 12.2 until it reaches an abutment, for example the inner side of a limb or a surface of the permanent magnets, at which it is held firmly by the field. The armature can be moved from one limb to the other, i.e. from one rest position to the other, by means of a positive or negative current pulse respectively, which is conducted through the winding 13.

In a further advantageous embodiment the winding 13 is connected to an energy store, for example an accumulator or condenser, with it being possible for the winding to be connected to the energy store, for example via a control circuit.

The electrical energy consumption of the thread clamp can be reduced further in that for example an additional mechanical and/or pneumatic actuation of the thread clamp is provided. The thread clamp can thereby, for example, be opened and closed electrically inside the shed and mechanically and/or pneumatically outside the shed.

Figure 2:
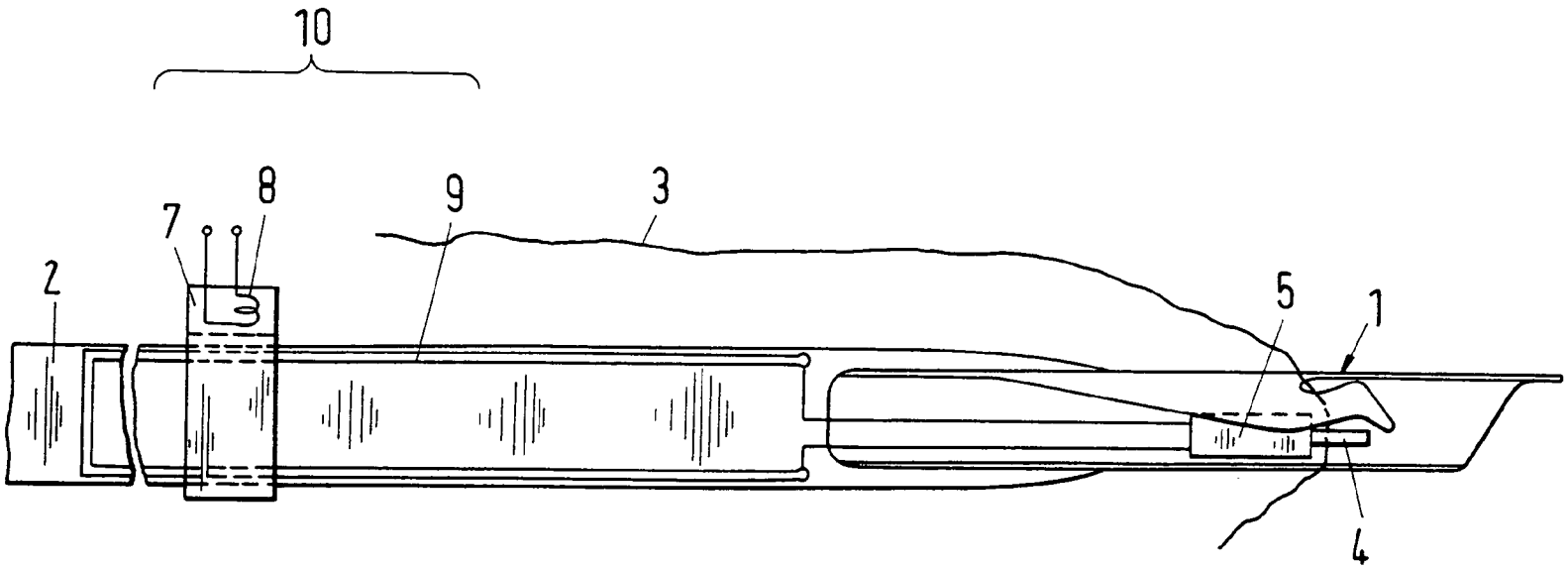
FIG. 2 is an exemplary embodiment of a power supply for a rapier head.

An exemplary embodiment of a power supply for the rapier head 1 will be described in the following with reference to FIGS. 1 and 2. The power supply 10 includes for example an inductive coupling device with at least one primary induction coil 8, which is arranged stationary in an advantageous embodiment, and with at least one secondary induction coil 9 which is inductively coupled to the primary induction coil. During operation the primary induction coil 8 is advantageously supplied with power by a generator, which operates for example at a frequency of from 5 kHz to 100 kHz. The inductive coupling device can, as shown in FIG. 1, additionally include a magnetizable core 7 which consists for example of transformer metal sheet or ferrite, and which e.g. has a slot through which the band 2 is led. The secondary induction coil 9 is formed on the band 2, for example in that one or more elongate conductor loops are embedded into the band or are applied to the band, for example through the laminating on of a copper film. In a further advantageous variant the secondary induction coil 9 extends over a length of at least 5 cm, at least 15 cm or at least 50 cm.

In an advantageous variant the secondary induction coil 9 is made so long that it does not depart from the field of the primary induction coil 8 during the forwards and backwards movement of the band 2, i.e. that the rapier head can be supplied with current during the entire weft insertion and/or weaving machine cycle without an intermediate store. In this case it is also possible to transfer information to the rapier head 1 via the inductive coupling device during the entire weft insertion and/or weaving machine cycle, for example information for the control of the thread clamp which is arranged in the rapier head. The information can for example be modulated onto the current flow which serves for the power supply or transferred by means of its own control pulses.

In the event that an energy store, such as for example an accumulator or condenser, is provided for supplying power to the actuator 5 or the winding 13 respectively, then the energy store is expediently connected to the secondary induction coil 9 via a converter. The secondary induction coil can in this case be made shorter, in particular shorter than the path which is traveled by the rapier head, since interruptions of the power supply via the inductive coupling device can be bridged by the energy store. During the time that the power supply via the inductive coupling device is interrupted, or also generally, control information can be transmitted e.g. optically or by means of high frequencies to the rapier head, with it being possible for the secondary induction coil in the latter case to be used as an antenna. Moreover, the thread clamp in the rapier head can also be controlled via a sensor, such as e.g. a proximity sensor, which is arranged in the rapier head.

It is advantageous that with the thread clamp which is described in the present application and with the rapier head which is likewise described here the electrical energy consumption can be reduced in comparison with conventional thread clamps with electromagnetic actuators, since the actuator of the above-described thread clamp requires no current in the open and closed states. The heating up of the actuator in accordance with the present application can thereby be reduced and the actuator can be made smaller and lighter.

The invention claimed is:

1. Thread clamp for a rapier head, which includes a clamping part for firmly clamping a weft thread and an actuator for moving the clamping part, said actuator including a ferromagnetic core, an armature and at least one winding which is arranged on the core or armature in order to produce a magnetic field in the core and the armature and to move the armature and the clamping part, which is operatively connected to the armature, characterized in that the armature is arranged movably between a first and a second rest position; and in that at least one holding means is provided which firmly holds the armature in the first rest position and in the second rest position respectively, when the winding is current-free.

2. Thread clamp in accordance with claim 1, wherein the core is formed in U-shape and has two limbs.

3. Thread clamp in accordance with claim 1, wherein at least one permanent magnet is provided as a holding means.

4. Thread clamp in accordance with claim 1, wherein the core includes two limbs, between which the armature is movably arranged, and wherein two permanent magnets are provided in order to firmly hold the armature in each case at one of the two limbs when the winding is current-free.

5. Thread clamp in accordance with claim 1, wherein the core and/or the armature is constructed of transformer metal sheet.

6. Thread clamp in accordance with claim 1, wherein the clamping part is formed on the armature.

7. Thread clamp in accordance with claim 1, wherein the winding is connected to an energy store.

8. Thread clamp in accordance with claim 1, wherein the thread clamp can additionally be actuated mechanically and/or pneumatically.

9. Rapier head including a thread clamp in accordance with claim 1.

10. Rapier weaving machine including a thread clamp in accordance with claim 1.

11. Rapier weaving machine including a rapier head in accordance with claim 9.

12. Thread clamp in accordance with claim 1, wherein the winding is connected to an energy store in particular via a control circuit.

13. Thread clamp in accordance with claim 1, wherein the armature is formed as a toggle or rocker armature which is rocked about an axis between the first current-free and second current-free rest positions, the axis being transverse to a longitudinal axis of the armature.

14. Thread clamp in accordance with claim 13, wherein the first current-free rest position corresponds to an open clamping part, and the second current-free rest position corresponds to a closed clamping part.

* * * * *